United States Patent [19]

Cranston

[11] Patent Number: 4,565,399

[45] Date of Patent: Jan. 21, 1986

[54] DISPOSABLE LIFTING LOOP AND METHOD OF LIFTING A CARGO LOAD THEREWITH

[75] Inventor: W. Charles Cranston, Kotka, Finland

[73] Assignee: Cranston Ky, Kotka, Finland

[21] Appl. No.: 637,321

[22] Filed: Aug. 1, 1984

Related U.S. Application Data

[63] Continuation of Ser. No. 467,473, Feb. 17, 1983, abandoned, which is a continuation of Ser. No. 189,076, Sep. 22, 1980, abandoned.

[30] Foreign Application Priority Data

Sep. 25, 1979 [FI] Finland ..... 792982

[51] Int. Cl.[4] ..... B66C 1/18

[52] U.S. Cl. ..... 294/74

[58] Field of Search ..... 294/67 R, 67 E, 67 EA, 294/74, 81 R; 140/73–75, 93 B, 93 C, 111; 206/83.5, 451, 597

[56] References Cited

U.S. PATENT DOCUMENTS

| | | | |
|---|---|---|---|
| 3,413,027 | 11/1968 | Bohlin et al. | 294/74 X |
| 3,672,006 | 6/1972 | Fidrych | 294/74 X |
| 3,782,772 | 1/1974 | Cranston et al. | 294/81 R X |
| 4,240,659 | 12/1980 | St. Germain | 294/74 |

FOREIGN PATENT DOCUMENTS

| | | | |
|---|---|---|---|
| 2847563 | 5/1979 | Fed. Rep. of Germany | 294/74 |
| 2355548 | 9/1979 | Fed. Rep. of Germany . | |
| 54280 | 7/1978 | Finland . | |
| 1261479 | 4/1961 | France | 206/83.5 |
| 1398950 | 4/1965 | France . | |
| 89920 | 7/1967 | France | 294/74 |
| 2407886 | 6/1979 | France | 294/74 |
| 1241849 | 8/1971 | United Kingdom | 294/74 |
| 1325207 | 8/1973 | United Kingdom . | |
| 1495604 | 12/1977 | United Kingdom . | |

*Primary Examiner*—Johnny D. Cherry

*Attorney, Agent, or Firm*—Scully, Scott, Murphy & Presser

[57] ABSTRACT

A method of providing a load with a disposable endless wire loop and a wire loop for use therein. According to the present method, the lifting loop is formed at the lifting location, such as in a harbor, by connecting together a required number of endless prefabricated steel wire rings. The lifting loop comprises endless steel wire rings whose number is defined by the weight of the load and which are bound together for forming the loop.

11 Claims, 5 Drawing Figures

DISPOSABLE LIFTING LOOP AND METHOD OF LIFTING A CARGO LOAD THEREWITH

Figure 1:
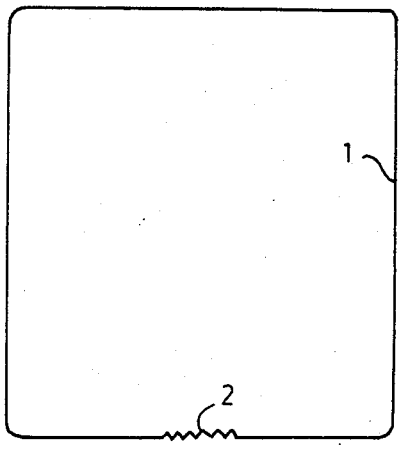

This is a continuation of co-pending application Ser. No. 467,473 filed Feb. 17, 1983, now abandoned, which is a continuation of application Ser. No. 189,076 filed Sept. 22, 1980, now abandoned.

The present invention relates to a method of providing a load with a disposable endless steel wire loop intended for lifting said load and having a shape approximately corresponding to the circumferential line of said load, said steel wire loop being threaded around said load before lifting. The invention also relates to a steel wire loop for use in said method.

It is known to encircle such loads, such as sawnwood, plywood and log loads, with wires or plaited nylon ropes before lifting them in harbours from the quay aboard a ship or vice versa. The initial price of both wires and plaited ropes is high wherefore they usually are used several times. When used in this way, the safety regulations require that the wires and ropes be inspected each time before they are used, which is a time-consuming step. The big length of the wires (about 6 to 9 meters), the required high number for each ship (a ship usually has about 1,000 to 3,000 wires), and the rigidity of the wires make them difficult to store and to handle, while plaited ropes often disappear because they are suitable for private use.

It is known to encircle various packages with steel wire loops in automatic binding machines. In addition, it is known to encircle loads in automatic machines with a plurality of steel wires of a circular cross-section, said wires being positioned in the same location and being used as lifting loops, for example, in connection with a later loading of a ship. This method is used especially in the cellulose industry where cellulose bales are at the cellulose mill bound together for forming loads which are encircled by endless disposable lifting loops.

Although the same method could be used also in other fields, for example, in connection with sawnwood, plywood parcels or log bundles, this had not been done mainly for economic reasons. The automatic binding machines plus their feeding and discharging means required for forming such cargoes are namely so expensive that the required capital investment would be too high as compared to the material quantity to be bound.

From French Patent Specification No. 1,398,950 is known a disposable ring made of rigid steel wire which is preformed into the shape of the load and threaded around the load before lifting. Because such a ring permits only a specific maximum lift, rings made of wires of different thicknesses must be made for cargoes of different weights. Therefore, for example, in harbours where the weight of the load varies considerably, there must be a large number of rings of different thicknesses. Because, moreover, a stiff steel wire is used in these rings, they cannot any more be deformed after the manufacture, wherefore rings of a multitude of different shapes must be kept in stock.

Finnish Patent Specification No. 54,280 describes a load lifting means made of endless stiff wire, such as steel wire which is bent in advance into a shape corresponding to the contour of the load to be lifted. This lifting means suffers from the same disadvantages as the ring according to the above-mentioned French Patent Specification, i.e. because each lifting means has a maximum lifting capacity defined by the thickness of the steel wire, means having different lifting capacities must be kept in stock in the place of use, for example, in a harbour. Moreover, the rigid steel wire cannot be deformed after the manufacture of the means.

The object of the present invention if to provide a method of providing a load with a lifting loop which requires no automatic binding machine and which will be very inexpensive both as far as the initial costs and the use of the lifting loop are concerned. Said method is characterized in that said steel wire loop is assembled on the spot, before threading, of endless, prefabricated steel wire rings whose number is defined by the weight of the load and which are bound together for forming said loop.

The lifting loop according to the invention is thus formed on the lifting location, such as in a harbour, by means of connecting toegether a required number of steel wire rings. This makes it possible, on one hand, to manufacture all steel wire rings of a steel wire of the same thickness, which simplifies the manufacture and the storage, and, on the other, to dimension the lifting capacity of the lifting loop according to the requirements of each load, owing to which no steel will be lost because of an overdimensioned lifting capacity.

A steel wire loop according to the invention is characterized in that said steel wire loop comprises endless steel wire rings whose number is defined by the weight of the load and which are bound together for forming said loop.

The steel wire loop according to the invention may be characterized in that said steel wire loop comprises endless prefabricated semi-rigid steel wire rings which permit the formation of angles in the loop in order to facilitate lifting various shaped loads. The wire rings are bound together at a few points by means of tape.

In an angular loop, the tapes are preferably located in the neighbourhood of the angles. When the loop, while lifting the load, is deformed, the tapes are partly broken, which indicates that the loop has already once been used.

In order to facilitate the selection of a correct lifting loop, the colour of the tape may vary according to the lifting capacity of the steel wire loop, i.e. according to the number of the rings included therein.

In order to keep the thickness of the loop uniform, the wire joints are preferably located in different places in the loop.

Figure 3:
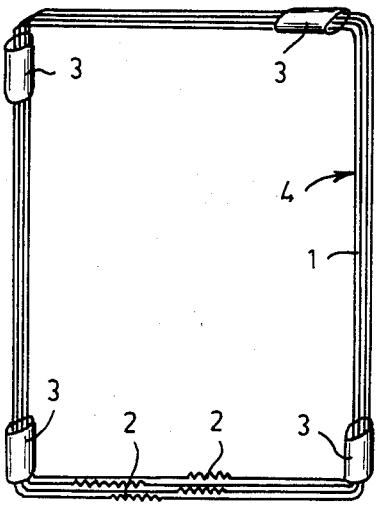
Figure 4:
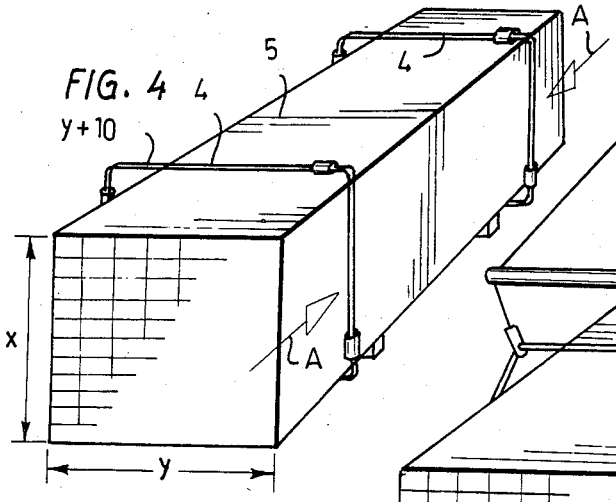
Figure 5:
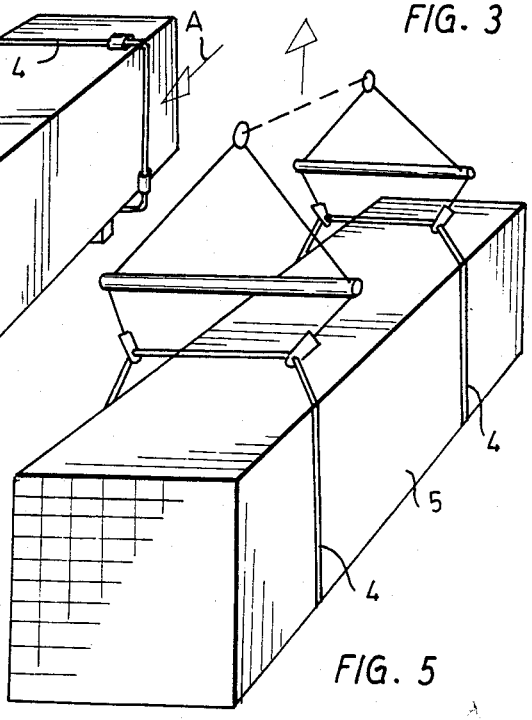
Figure 2:
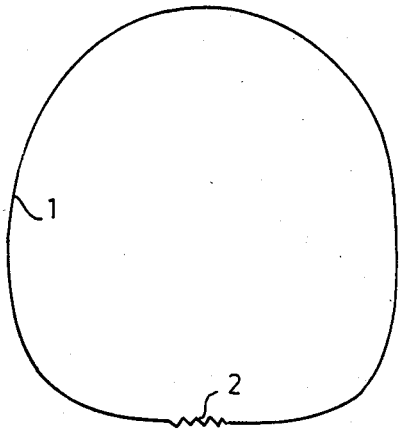

The invention will be described in more detail with reference to the accompanying drawing in which FIG. 1 illustrates a rectangular steel wire ring, FIG. 2 illustrates an approximately circular steel wire ring, FIG. 3 illustrates a lifting loop assembled of a plurality of rings, FIG. 4 illustrates a load around which are arranged two steel wire loops according to the invention, and FIG. 5 illustrates the load according to FIG. 4 in a lifting step.

The rings 1 shown in FIGS. 1 and 2 are made, for example, of galvanized steel wire of a circular cross-section. The ends of the wire are mechanically connected to each other in a conventional manner in a connection point 2 for forming a closed ring. In connection with their manufacture, the rings are given a shape desired by the buyer. FIGS. 1 and 2 show two examples of such shapes. Because the steel wire is semi-rigid, the shape may be later somewhat deformed. The rings 1 can be manufactured either in the manner described in the above-mentioned examples of one wire turn or by means of winding the same wire in a plurality of turns, for example, three times before connecting the ends together in the connection point 2.

Depending on the required lifting capacity, a desired number of rings 1 of a similar shape can be connected together by means of a tape 3 for forming a manifold lifting loop 4. In an angular loop, the tapes are preferably positioned in the neighbourhood of the angles, and the colour of the tapes varies according to the number of rings. The connection points 2 are partly displaced in relation to each other. The lifting loop according to FIG. 3 comprises four rings.

FIG. 4 illustrates how two lifting loops 4 are threaded on a load 5 from the ends in the direction of the arrows A while the load is located, for example, on a platform or on the fork of a truck. The lifting loops are of a similar shape as the circumference of the end surface of the load, and each side is somewhat, for example, 10 cm longer than the corresponding end surface of the load. Owing to this, the loops can be quickly threaded on the load.

FIG. 5 illustrates a lifting step of the load in which the lifting loop is deformed, which later indicates that the loop has been used.

It is to be noted that the lifting loop can be arranged around a load in any transport step of the load. For this reason, loops of various thicknesses and shapes must usually be kept in stock. When the load has been lifted, for example, aboard a ship, the lifting loops follow along with the load to the port of destination where the load is unloaded by using the same lifting loops. Hereafter the loops are discarded from this use and sold as scrap or to any other less demanding use.

What I claim is:

1. A disposable lifting loop arrangement for use only once in lifting a load, after which it is disposed of an not reused, thereby generally reducing the time required for a loading operation, while also enhancing the safety of the load lifting operation, comprising: an endless steel wire loop (4) which is formed from a plurality of disposable prefabricated semi-rigid steel wire rings (1) bound together in a group by binding means at a plurality of spaced locations around the wire loop, each semi-rigid steel wire ring having a substantially circular cross-sectional shape, and the semi-rigid steel wire rings having a larger circumference that the circumference of the load, such that the loop can be easily placed around the load, and the rings being designed to be deformed to conform to the shape of the load, particularly the lower corners of the load to minimize damage thereto, while also being sufficiently rigid to retain a predetermined configuration of the loop such that the loop can extend beyond the load to facilitate the application thereto and the removal therefrom of a lifting mechanism, with the construction of the loop from the disposable steel wire rings allowing the loop to be formed on site for use with a variety of different size and shape loads because of the ability to select the number of steel wire rings forming the loop.

2. A disposable lifting arrangement as specified by claim 1, wherein the binding means includes tapes (3) positioned at a spaced plurality of points on the wire loop (4), and each tape surrounding the rings to bind the rings together.

3. A disposable lifting arrangement as specified by claim 2, wherein the loop (4) is deformed so as to form a plurality of spaced angles about its periphery, and a tape (3) is located adjacent to one of the formed angles.

4. A disposable lifting arrangement as specified by claim 2, wherein each tape (3) indicates the lifting capacity of the loop (4).

5. A disposable lifting arrangement as specified by claim 1, wherein each ring (1) is formed from a wire having two ends joined together to form a joint, the joint of each ring (1) located at a circumferential position on the loop (4) spaced from the joints of the other rings, thereby maintaining uniform thickness of the loop (4).

6. A method of lifting a cargo load, such as in the loading and unloading of a vessel, comprising:

a. assembling a plurality of any new disposable prefabricated semi-rigid steel wire rings (1), into an endless steel wire loop (4) by binding the wire rings together into a group at a plurality of spaced locations around the wire loop, each semi-rigid wire ring having a substantially circular cross-sectional shape, and the loop having a larger circumference than the circumference of the load, such that the loop can be easily placed around the load, and the construction of the loop from the new disposable steel wire rings generally reducing the time required for a cargo loading operation, while also enhancing the safety of the load lifting operation, and the construction of the wire loop allowing the loop to be formed on site for use with a variety of different size and shape cargo loads because of the ability to select the number of steel wire rings forming the loop;

b. placing the wire loop (4) loosely around the circumference of the load, with the wire loop being sufficiently rigid to retain a predetermined configuration of the loop such that the loop extends upwardly beyond the cargo load to facilitate the application thereto and the removal therefrom of a lifting mechanism;

c. lifting the cargo load with the wire loop (4), with the semi-rigid steel wire rings being designed to be deformed to conform to the shape of the cargo load, particularly at the lower corners of the cargo load to minimize damage thereto; and d. disposing of the wire loop (4) after the load lifting operation is completed, whereby the next cargo load lifting operation employs a similar but new wire loop which generally reduces the time required for each cargo load lifting operation while enhancing the safety thereof.

7. A method of lifting a cargo load as claimed in claim 6, wherein said step of assembling includes the step of forming the wire loop on site at the cargo loading operation by selecting the number of steel wire rings forming the loop generally in dependence upon the weight of the cargo load.

8. A method of lifting a cargo load as specified by claim 6, wherein said step of binding includes placing tapes (3) at a spaced plurality of locations on the wire loop (4), with each tape surrounding the rings to bind the rings together.

9. A method of lifting a cargo load as specified by claim 8, wherein the loop (4) is deformed so as to form a plurality of spaced angles about its periphery, and a tape (3) is placed adjacent to one of the formed angles.

10. A method of lifting a cargo load as specified by claim 8, further including marking a tape (3) to indicate the lifting capacity of the loop (4).

11. A method of lifting a cargo load as specified by claim 6, wherein each ring (1) is formed from a wire having two ends joined together to form a joint, and locating the joint of each ring (1) at a circumferential position on the loop (4) spaced from the joints of the other rings, thereby maintaining a relatively uniform thickness of the loop.

* * * * *